US007316080B1

(12) United States Patent
Woolsey

(10) Patent No.: US 7,316,080 B1
(45) Date of Patent: Jan. 8, 2008

(54) METHODOLOGY AND APPARATUS TO REDUCE FUEL CONSUMPTION IN CONVEYOR DRYERS AND OVENS

(75) Inventor: Rick L. Woolsey, Olathe, KS (US)

(73) Assignee: Solution Dynamics, LLC, Paola, KS (US)

( * ) Notice: Subject to any disclaimer, the term of this patent is extended or adjusted under 35 U.S.C. 154(b) by 0 days.

(21) Appl. No.: 11/138,558

(22) Filed: May 26, 2005

Related U.S. Application Data

(60) Provisional application No. 60/574,918, filed on May 27, 2004.

(51) Int. Cl.
*F26B 3/04* (2006.01)

(52) U.S. Cl. ..... 34/509; 34/207; 34/210; 34/216; 34/223; 34/231

(58) Field of Classification Search ..... 34/443, 34/507–510, 130, 209, 210, 212, 215, 216, 34/217, 218, 219, 223–225, 241, 207, 231; 432/121–123, 126–128, 143–146, 152–155, 432/176, 199
See application file for complete search history.

(56) References Cited

U.S. PATENT DOCUMENTS 4,249,895 A * 2/1981 Mantegani ..... 432/128
4,773,851 A * 9/1988 Mueller ..... 432/48

* cited by examiner

*Primary Examiner*—Jiping Lu
(74) *Attorney, Agent, or Firm*—Erickson & Kleypas, LLC

(57) ABSTRACT

A method and apparatus for reducing fuel consumption in conveyor ovens by creating a barrier to the infiltration of heated air from a heating section of the oven into a cooling section of the oven thereby reducing the loss of heated air and reducing consumption of fuel otherwise required to maintain the selected oven temperature. The barrier is formed by directing a stream of pressurized air into a transition section between the heating and cooling sections of the oven.

18 Claims, 12 Drawing Sheets

METHODOLOGY AND APPARATUS TO REDUCE FUEL CONSUMPTION IN CONVEYOR DRYERS AND OVENS

CROSS-REFERENCE TO RELATED APPLICATIONS

This application claims the benefit of the filing date of U.S. Provisional Patent Application Ser. No. 60/574,918, filed May 27, 2004.

BACKGROUND OF THE INVENTION

The invention relates to product dryers or ovens and in particular to air convection conveying dryers or ovens having a cooling section connected to a heating section.

Various types of products are dried, baked or toasted in convection type conveying dryers or ovens such as charcoal, pet foods, fish foods, foods for human consumption such as breakfast cereals and snack foods and other particulate type materials which may also include material in granular and flake forms. As used herein, the terms dryer and oven may be used interchangeably. A typical convection dryer includes one or more conveyer-driven product passes, convection or circulation fans, burners for elevating the temperature within a heating or drying section, and a cooling section. An upper conveyor may receive product to be dried, carry it the length of the drying section for a first product pass and then deposit it upon a lower conveyor that carries the product back through the length of the drying section for a second product pass. The cooling section is often constructed as an extension of the lower portion of the drying section that houses the second, lower conveyor in order to reduce fabrication costs and provide a more compact assembly, as compared to a separate dryer and a separate cooler. In such configurations, the lower conveyor is typically longer than the upper conveyer so that it may project into the cooling section. The conveyors are generally porous or perforated, with pores or openings sized large enough to permit heating and cooling air to pass through the conveyor and the bed of particulate material supported thereon, but small enough to prevent the particulate material from falling therethrough.

To initiate the drying process, product is introduced into the drying zone of the dryer and deposited on the conveyor. A process air stream in the drying section consists of a moving stream of heated air that removes moisture from the product as it is carried through the process air stream on the conveyor bed.

It is important that the temperature of the process air be controllable to avoid over or under heating of the process air which would lead, respectively, to detrimental effects on the product being dried or reduction in process efficiency and greater energy cost. In addition, it is important that the heated process air be contained in the dryer until exhausted through a dryer exhaust, and not lost to the cooling zone where it would hamper cooling of the product. During a steady state operating condition any lost or exhausted process air from the dryer must be compensated for through the introduction of freshly heated makeup air.

Dryers and other types of ovens are available with various airflow configurations, including some that cause air to flow upward through the product (air-up), some that cause air to flow downward through the product (air-down) and various combinations in which the air may flow both up and down through the product bed in different sections of the dryer depending upon the requirements of the end user and the product to be dried and cooled. The purpose of the convection or circulation fan or fans associated with the drying section is to force heated air through the product bed. Therefore, a positive pressure is exerted on one side of the product bed by the air flow from the fans and a negative pressure is created on the other side of the product bed.

Typically, a dryer inlet and transition section separates the drying section from the cooling section of the dryer. Cooling sections move fresh air through the dried product to cool it and are generally built in an air-down configuration, such that the air pressure beneath the product bed is less than the air pressure above the product bed during the cooling process. Baffles are usually installed in the transition section in order to minimize the amount of heated air that migrates from the drying section to the cooling section, but such baffles are only partially effective because the product bed is moving along a conveyor and the openings for the conveyor prevent forming of an effective seal between the drying section and the transition section.

Because the area beneath the product bed in the cooling section is typically at a relative negative pressure compared to the pressure beneath the bed in an air-up configured drying section, a large amount of heated air tends to migrate from the drying section to the cooling section. This unnecessarily increases fuel consumption in the heating or drying section.

SUMMARY OF THE INVENTION

The present invention includes the equipment and processes necessary to neutralize the pressure differential between the heating section and the transition section, typically through partial pressurization of the transition section. Partial pressurization of the transition section effectively neutralizes the pressure differential between the heating section and the cooling section. Pressurized air may be delivered to the transition section by a diffuser inserted below an upper or conveying run of a conveyor which extends from the heating section, through the transition section and into the cooling section. The pressurized air for the diffuser may be generated by an auxiliary fan or may be supplied by diverting a portion of the exhaust from the cooling section fan. In one embodiment, the diffuser may include upper and lower projections or baffles to span a substantial portion of the gap between the upper and lower runs of the conveyor to function as a physical barrier to the movement of heated air from the heating section to the cooling section of the dryer.

Other advantages of the invention will become apparent from the following description taken in connection with the accompanying drawings, wherein is set forth by way of illustration and example embodiments of the present invention.

DETAILED DESCRIPTION

Figure 1:
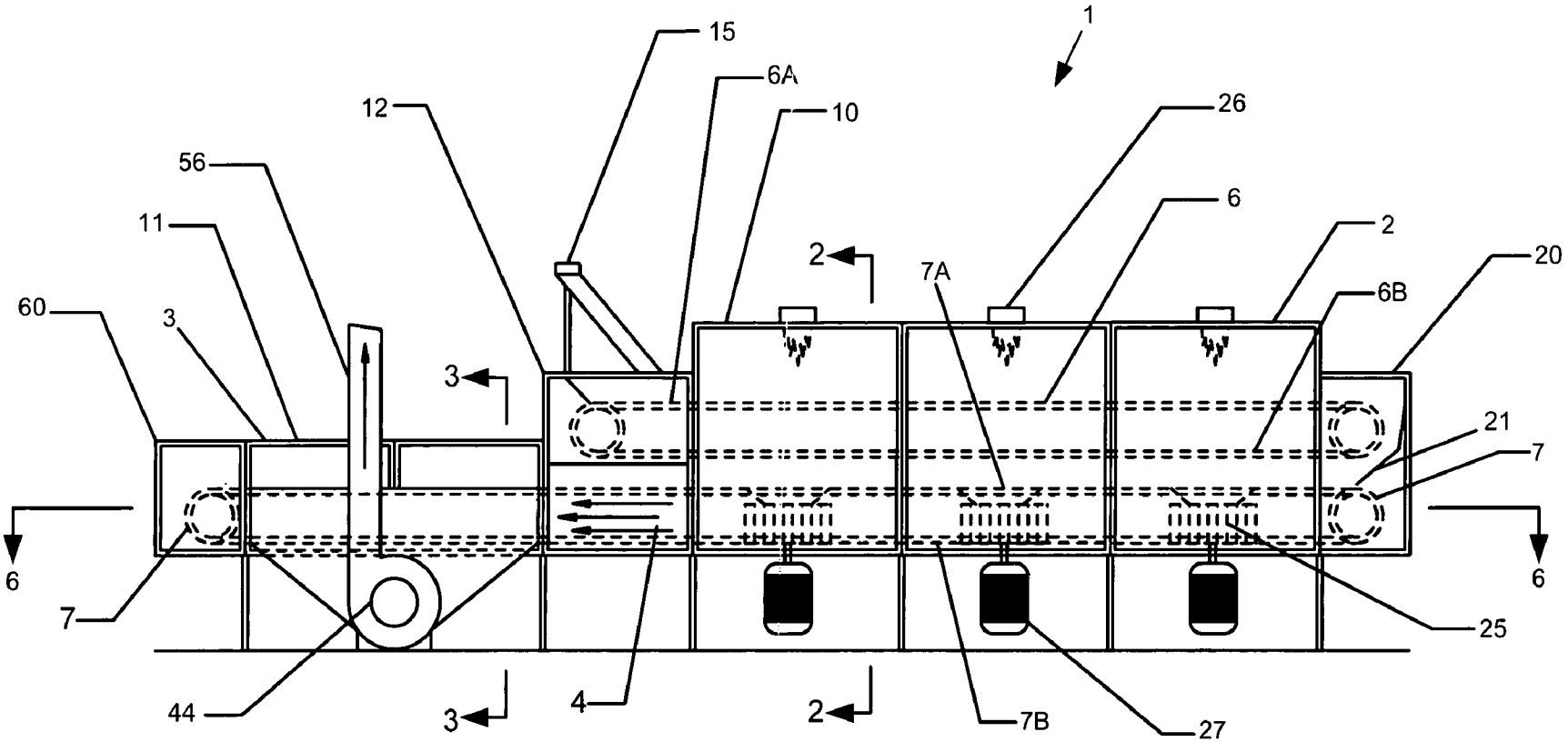
Fig. 1 Prior Art
FIG. 1 is a longitudinal diagrammatic view of a first embodiment of a prior art conveyor dryer.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawings, and with particular reference to FIG. 1, there is shown, for the purposes of later comparison to the developments of the present invention, a longitudinal, diagrammatic view of a two-pass, conveyor dryer 1 of the prior art. The conveyor dryer 1 includes a heating or drying section 2 separated from a cooling section 3 by a transition section 4. Product is conveyed through the dryer on two sets of conveyors, an upper conveyor 6 and a lower conveyor 7. Each of the conveyors 6 and 7 generally comprises a continuous loop formed from a series of perforated pans linked together. The upper conveyor includes an upper, conveying run 6A and lower, return run 6B and the lower conveyor 7 includes an upper, conveying run 7A and a lower, return run 7B.

Each of the conveyor dryer sections is enclosed by a housing, typically formed of sheet metal, including a drying section housing 10, a cooling section housing 11 and a transition section housing 12. The upper conveyor 6 extends from the transition section 4 and through the drying section 2, from the front to the rear of the drying section house 10. The lower conveyor 7 generally runs the entire length of the dryer 1 from the rear of the drying section 2, through the transition section 4 and into the cooling section 3 to a front end thereof.

Figure 2:
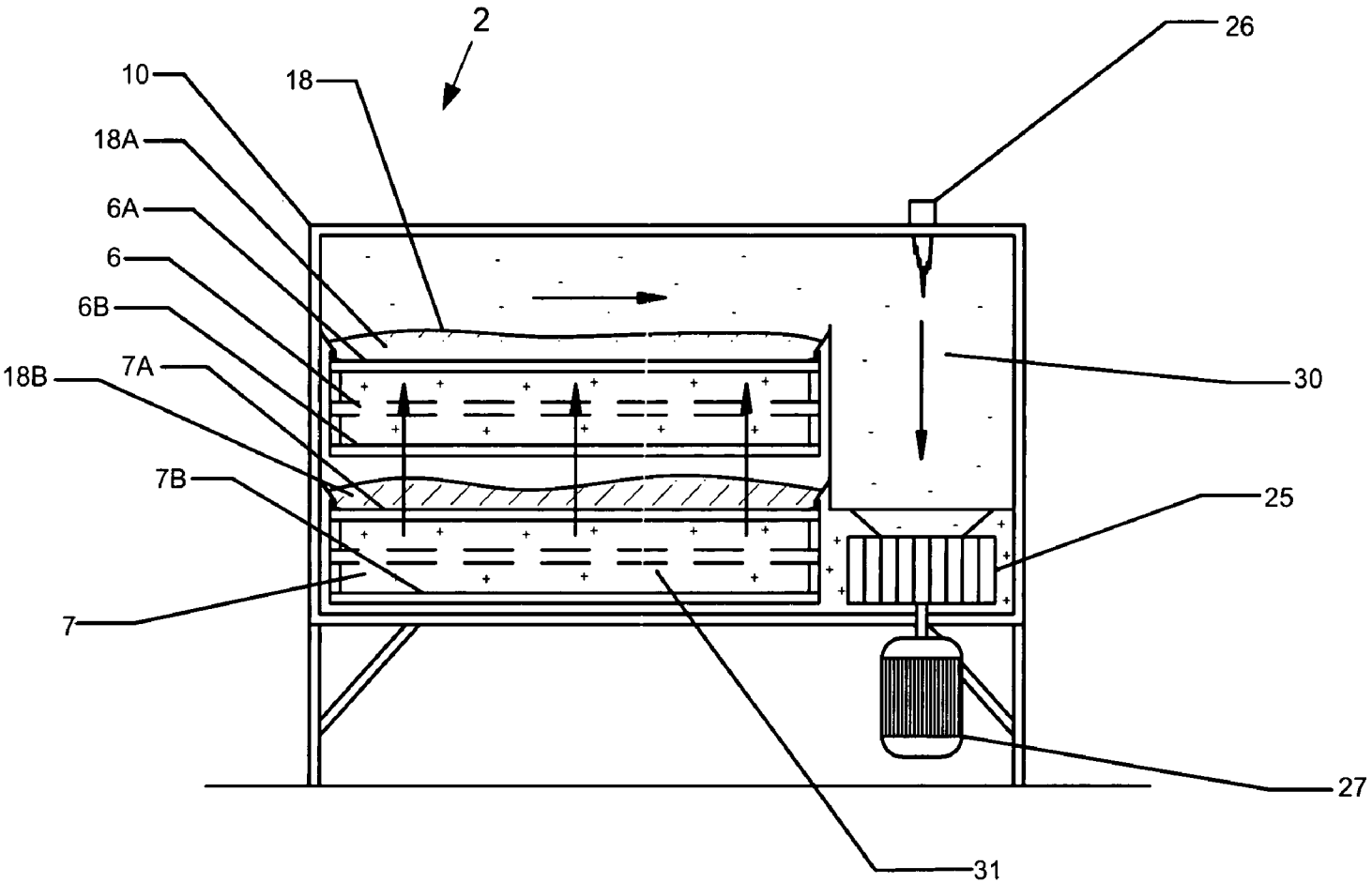
Fig. 2 Prior Art
FIG. 2 is a transverse cross-sectional diagrammatic view of a drying section of the conveyor dryer taken along line 2-2 in FIG. 1.

Referring to FIG. 1 and following the course of product to be dried as it passes through the dryer 1, the product is first introduced into the dryer 1 through a product spreader 15 into the transition section 4 where it falls upon the conveying run 6A of upper conveyer 6. As illustrated in FIG. 1, the upper conveyor 6 is moving product from left to right (from front to back). The product falls into the perforated or porous pans of the upper conveyor 6 as the pans pass beneath the spreader 15. As shown in FIG. 2, the product forms a product bed 18 on the pans of conveyor 6. The product bed 18 on the upper conveyor 6 may be referred to as an upper product bed 18A and the product bed on the lower conveyor 7 (discussed hereafter) may be referred to as a lower product bed 18B.

The upper conveyor 6 carries the product into the drying section 2. The rear end of the upper and lower conveyors 6 and 7 extend into a dryer return section 20 at the rear of the drying section 2. As the product in the upper product bed 18A is conveyed to the rear end of the upper conveyor 6, the product falls from the upper conveyor 6 onto the lower conveyor 7. A guide plate 21, extending across the end of the drying section 2, may be utilized to direct the product onto the lower conveyor 7 where it forms the lower product bed 18B.

In the drying section 2, air is circulated by dryer circulation fans or blowers 25 past burners 26 and through the product bed 18 and the perforated pans forming the upper and lower conveyors 6 and 7 to dry the product. The dryer circulation fans 25 are powered by electric motors 27 mounted below the fans 25. The drying section housing 10 forms an enclosure of the drying section 2 to retain heated air as it flows past lower and then upper product beds 18B and 18A respectively.

FIG. 2 is a transverse cross sectional view of the drying section 2 taken along line 2-2 of FIG. 1, including arrows which illustrate the air flow pattern in the drying section 2. Due to the action of the dryer circulation fans 25, an area of relatively low air pressure 30 is created in the portion of the drying section 2 leading from the burners 26 to the fans 25, and an area of relatively high pressure 31 is created in the area or zone leading from the fans 25 to the lower product bed 18B. As illustrated, the dryer circulation fans 25 draw air past the burners 26 which heat the air. The heated air is then drawn through the fans 25 and forced outward by the fans 25 between the upper and lower runs 7A and 7B of the lower conveyor 7 and then upward through the upper run 7A of lower conveyor 7, through the lower product bed 18B and then through both runs 6A and 6B of the upper conveyor 6 and the upper product bed 18A. Air is then returned across the top portion of the drying section 2. A portion of the return air is exhausted through a duct or vent (not shown) to remove moisture evaporated from the product bed 18. The remaining air is circulated past the burners 25 to reheat the air prior to recirculation through the fan and then the product beds 18.

Figure 8:
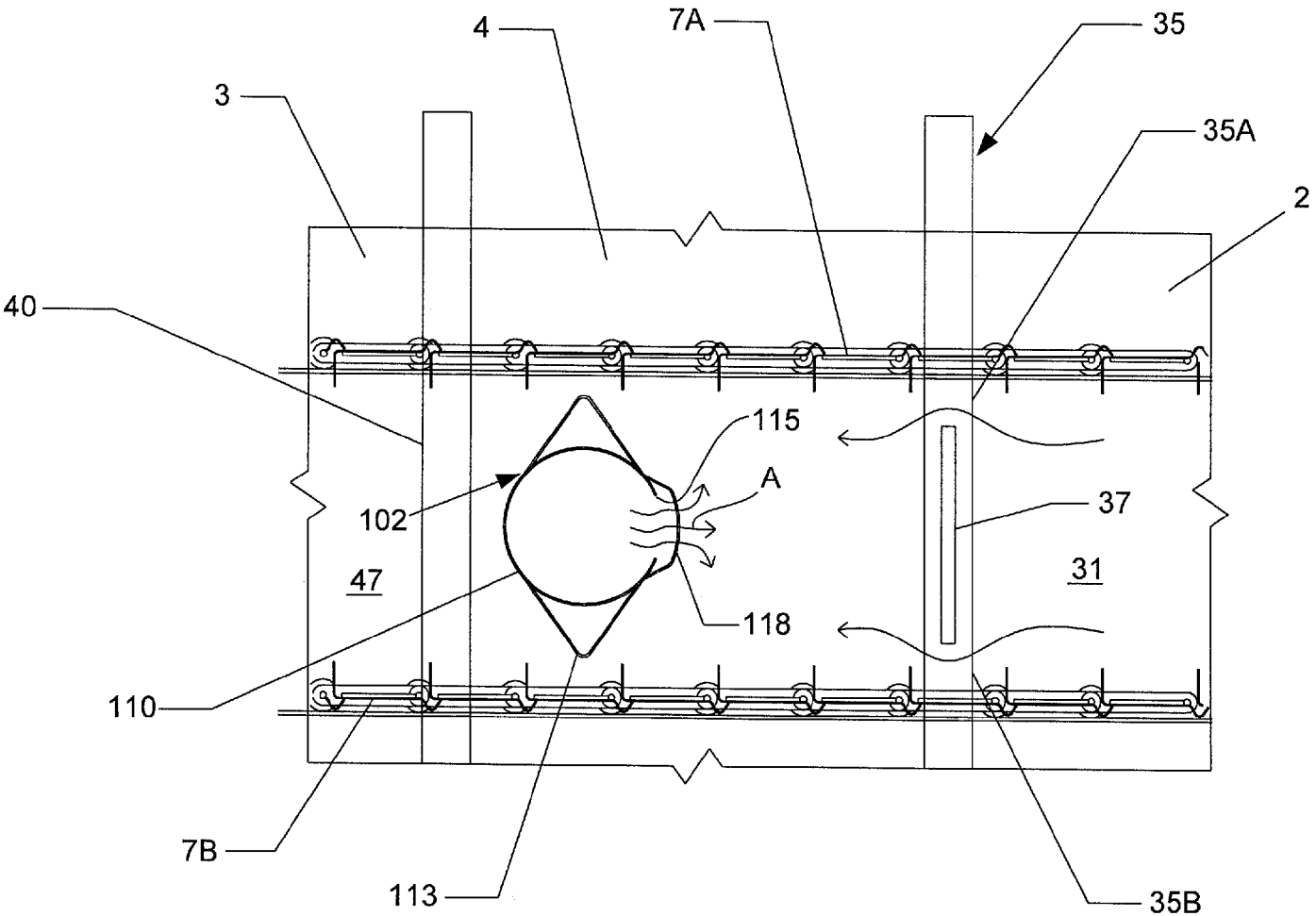
FIG. 8 is an enlarged and fragmentary cross-sectional view taken generally along line 8-8 of FIG. 6 showing the diffuser in the transition section between upper and lower runs of a product conveyor.

Referring to FIG. 8, which is a modified version of the dryer 1, as shown in FIG. 1, incorporating a diffuser as discussed in more detail below, the lower conveyor 7 extends from the drying section 2 into the transition section 4 through a drying section outlet or first passageway 35 extending between the drying section housing 10 and the transition section housing 12. A drying section baffle 37 typically extends across the drying section outlet 35 between the upper and lower runs 7A and 7B of the lower conveyor 7, to generally separate the drying section outlet into upper and lower dryer section outlet openings 35A and 35B. The lower conveyor 7 further extends into the cooling section 3 through a second passageway or cooling section inlet 40 extending between the transition section 4 and the cooling section 3. The cooling section inlet 40 may, or may not contain its own baffling system similar to what is illustrated in drying section outlet 35. Referring again to FIG. 1 with reference to the transition section 4, as enclosed by the transition section housing 12, no heating elements or burners are located in the transition section 4. In addition, no fan or blower or other air circulating means is located in the transition section 4 for circulating air in the transition section.

Figure 3:
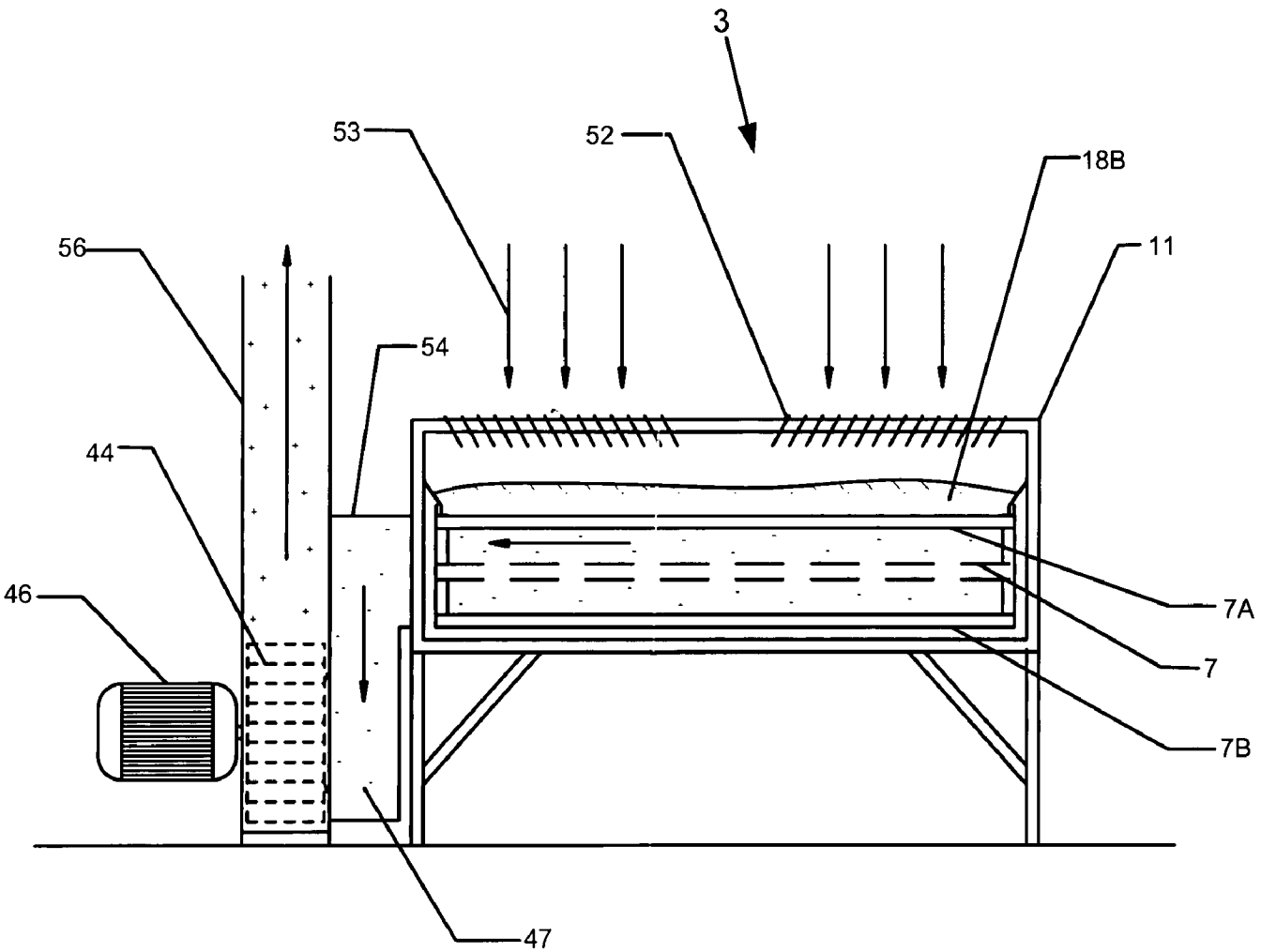
Fig. 3 Prior Art
FIG. 3 is a transverse cross-sectional diagrammatic view of a cooling section of the conveyor dryer taken along line 3-3 of FIG. 1.

Referring to FIG. 3, which is a transverse cross-sectional view of the cooling section 3 of the dryer 1 taken along line 3-3 of FIG. 1, a cooling fan or blower 44 driven by motor 46 pulls air through the cooling section housing 11 and the product bed 18B to cool the product on the lower conveyor 7 in the cooling section 3. The blower 44 creates an area of low pressure 47 on its inlet side causing ambient air to be pulled through vents 52 in the top of the cooling section housing 11, down through the product bed 18B and the upper, conveying run 7A of lower conveyor 7 as indicated by arrows 53. The cooling air is then drawn into the blower 44 through a blower inlet 54 from between the upper, conveying and lower return runs 7A and 7B. The blower 44 then exhausts the air to atmosphere through an exhaust duct 56. A portion of the air exhausted through duct 56 may be redirected back to the drying section 2. After cooling, the lower product bed 18B is conveyed to a discharge section 60 (see FIG. 1) where the product may be offloaded from the dryer 1.

The dryer outlet openings 35A and 35B (as shown in FIG. 8) and the cooling section inlet 40 allow heated air from the drying section 2 to migrate through the transition section 4 from the area of relatively high pressure 31 in the drying section 2 to the area of relatively low pressure 47 in the cooling section 3. The migration of hot air from the drying section 2 to the cooling section 4 decreases the overall efficiency of the dryer 1

Figure 4:
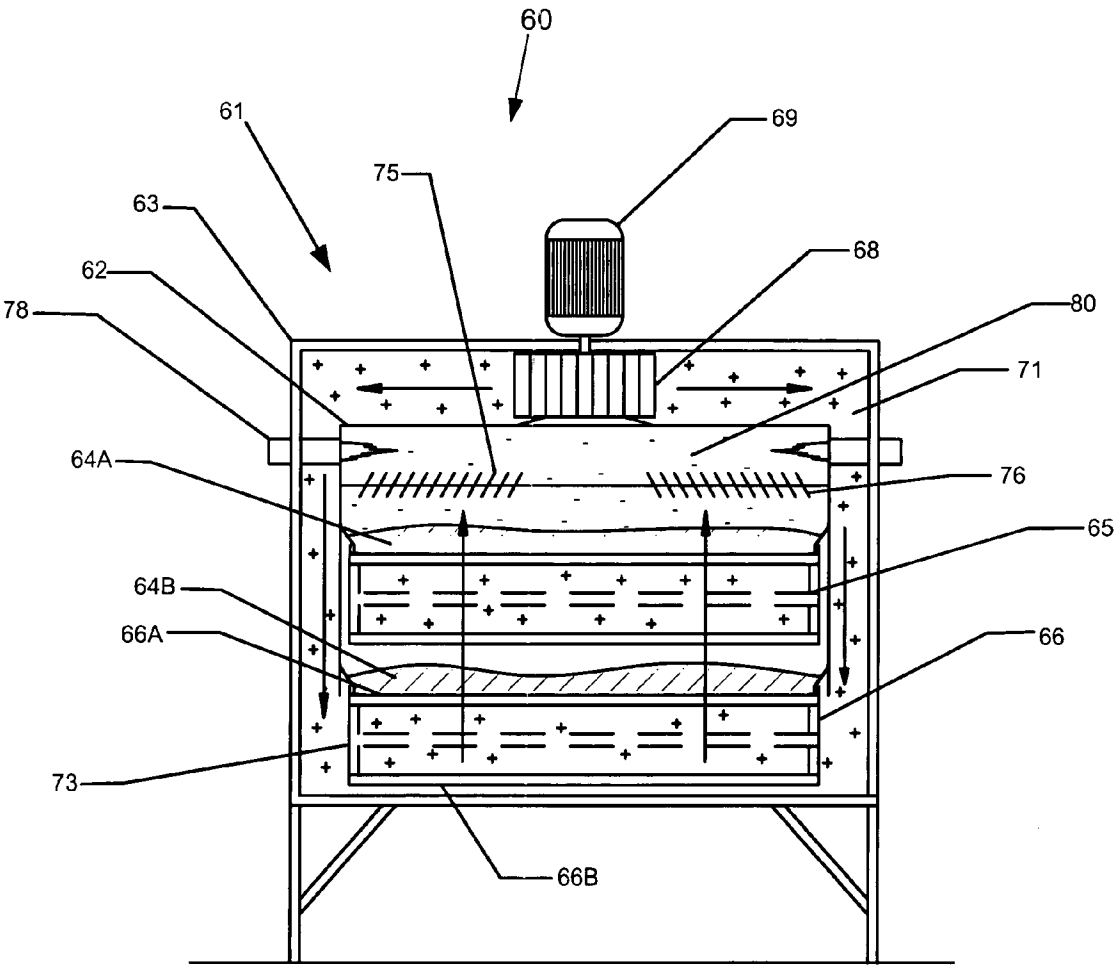
Fig. 4 Prior Art
FIG. 4 is a transverse cross sectional diagrammatic view of a drying section of a second embodiment of a conveyor dryer.

FIG. 4 is a transverse cross sectional diagrammatic view of an alternative embodiment 60 of the conveyor dryer, having a modified drying section 61. The drying section 61 includes an inner housing 62 and an outer housing 63. The inner housing 62 encloses product beds 64A and 64B on upper and lower conveyors 65 and 66 respectively. The inner housing 62 is enclosed by the outer housing 63. Air flow is created by a top-mounted blower 68 powered by motor 69 and which blows air downward in a gap 71 formed between the inner and outer housings 62 and 63. An opening 73 is formed in the inner housing such that pressurized air generated by blower 68 passes between upper and lower runs 66A and 66B of lower conveyor 66 and then upward through the lower product bed 64B and then through the upper conveyor 65 and the upper product bed 64A. The air then passes through air balancing vents 75 formed in the floor 76 of heating chamber heating chamber 80 which is contained in the inner housing 62. In the heating chamber 80 air flows past burners 78 to heat the air. The heated air is then drawn into the blower 68 through an opening in a roof of the heating chamber 80 and distributed back through the drying section in the manner discussed above. An area of relatively high pressure is created in the lower portion of the drying section 61 beneath the upper, conveying run 66A of the lower conveyor 66. An area of relatively low pressure is created in the area immediately below the blower 68.

Figure 5:
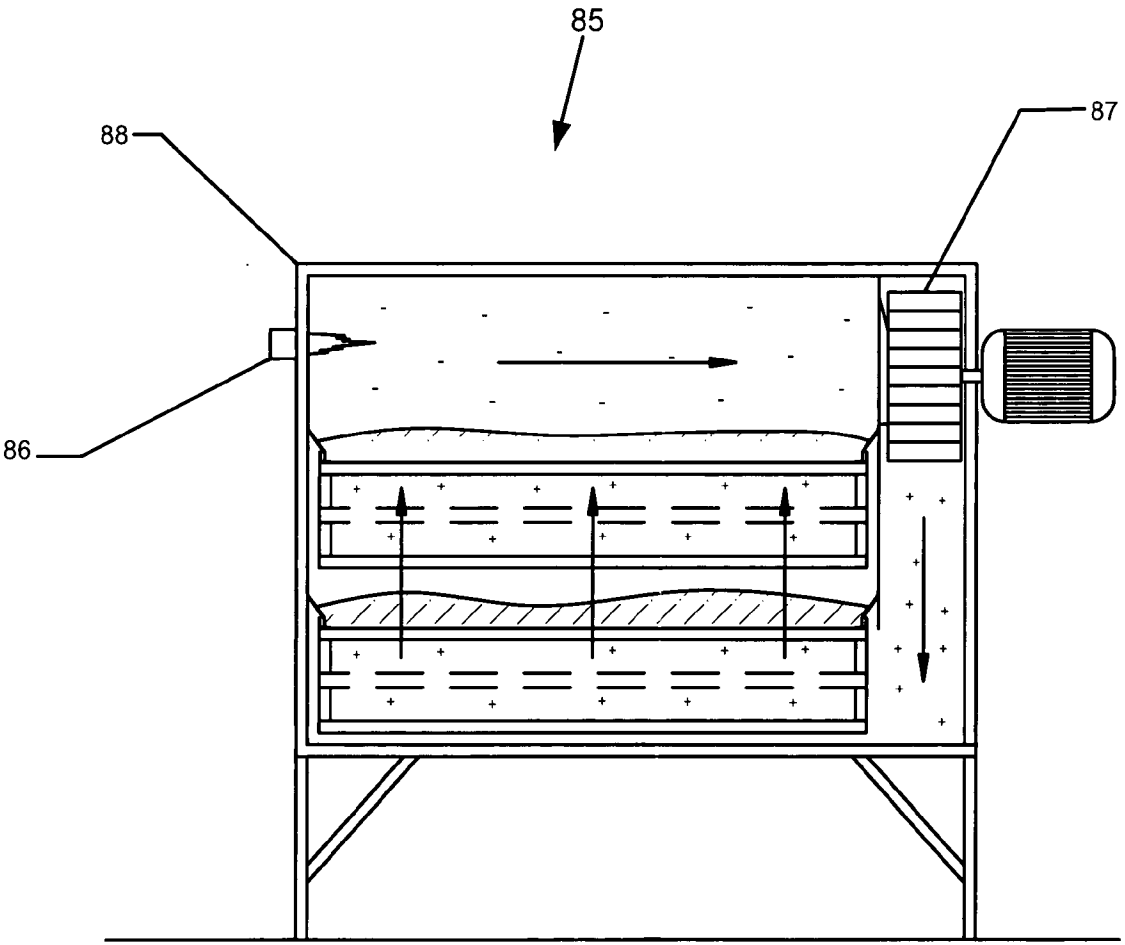
Fig. 5 Prior Art
FIG. 5 is a transverse cross sectional diagrammatic view of a drying section of a third embodiment of a conveyor dryer.

FIG. 5 illustrates a further embodiment 85 of the conveyor dryer as shown in FIG. 2 in which the burner 86 and blower 87 are mounted on transversely opposing sides of the drying section housing 88. Each of the embodiments described creates an area of relatively high pressure below the upper, conveying run 66A of the lower conveyor 7 and typically between the upper conveying run 66A and the lower, return run 66B. The pressurized heated air migrates out of the drying section 2, through the transition section 4, and toward the area of relatively low pressure in the cooling section 3 created by the cooling fan 44.

Figure 6:
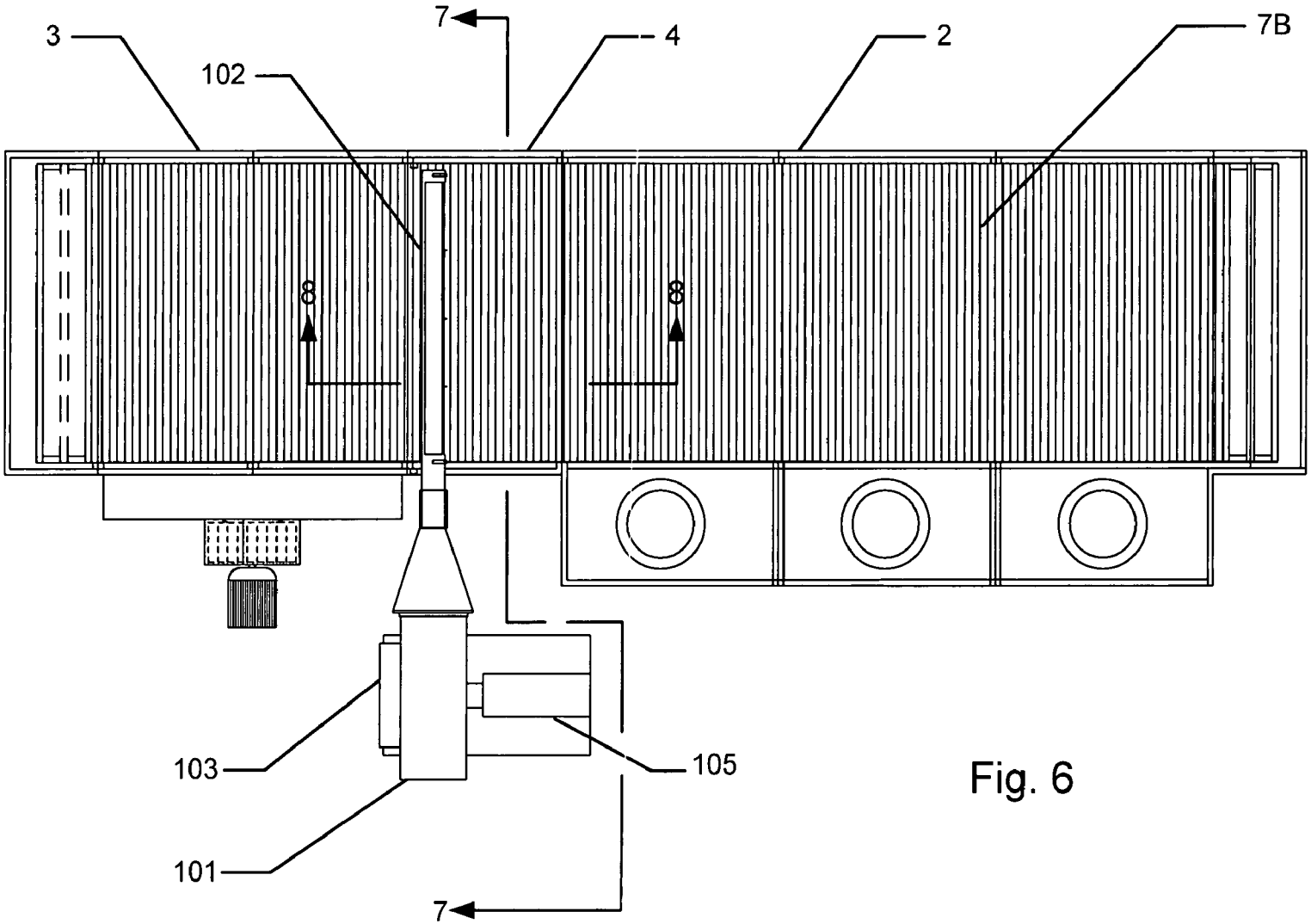
FIG. 6 is a diagrammatic cross-sectional view of a conveyor dryer of the type shown in FIG. 1, taken generally along line 6-6 of FIG. 1, with a transition section pressurization assembly added thereto for providing pressurized air to the transition section.
Figure 7:
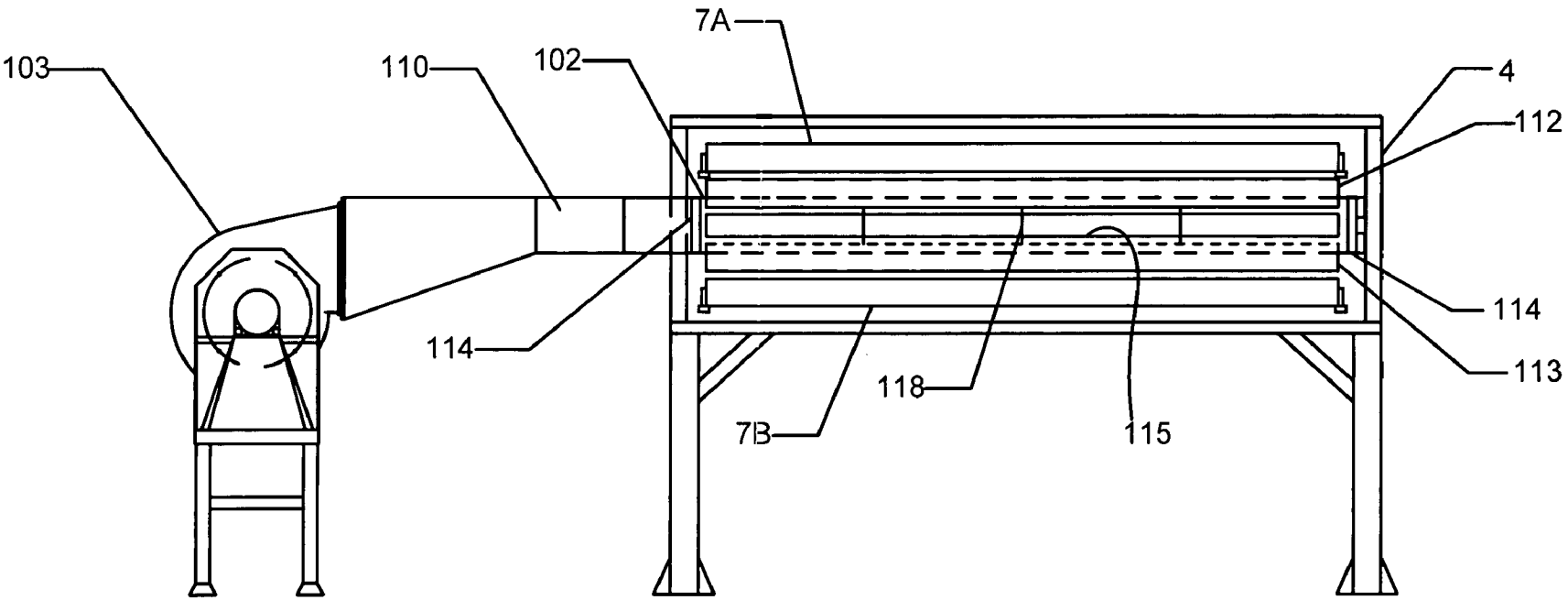
FIG. 7 is an enlarged and fragmentary cross-sectional view taken generally along line 7-7 of FIG. 6, showing a diffuser of the transition section pressurization assembly extending into the transition section of the conveyor dryer.

To prevent or resist such migration, and with reference to the embodiment shown in FIGS. 7-9 and 11, relatively cool pressurized air, typically ambient air, is introduced into the transition section 4 below the upper, conveying run 7A of the lower conveyor 7 and typically between the upper conveying run 7A and the lower return run 7B of the lower conveyor 7. In a preferred embodiment, as shown in FIGS. 6-8, the pressurized air is introduced into the transition section through a transition section pressurization assembly 101 having a diffuser or nozzle 102 which is inserted in the transition section 4 between the upper conveying run 7A and the lower return run 7B of the lower conveyor 7. The diffuser 102 is connected to a pressurization fan or auxiliary blower 103 on the discharge side thereof and the blower 103 is driven by a motor 105. The blower 103 draws in ambient air and distributes it through the diffuser 102 and into the transition section 4. As shown in FIGS. 6 and 7, the diffuser 102 preferably extends across most or a substantial portion of the width of the transition section 4 and generally distributes an even flow of air along the width of the transition section 4.

The diffuser 102 is formed from a cylindrical duct or conduit 110 with a pair of V-shaped baffles 112 and 113 connected to and extending across a substantial portion of that section of the cylindrical duct 110 positioned within the transition section 4 of the dryer 1. One of the baffles 112 is mounted on and extends above the duct 110 and the other baffle 113 is mounted on and extends below the duct 110. To maintain conveyor clearances, the distance between the top of baffle 112 and the bottom of baffle 113 is just shorter than the narrowest distance between the upper and lower runs 7A and 7B of lower conveyor 7. For example, the gap between the baffles 112 and 113 and the upper and lower runs 7A and 7B respectively may be approximately three-eighths of an inch.

The duct 110 with the baffles 112 and 113 mounted thereon, presents a physical barrier to the flow of air from the transition section 4 into the cooling section 3. The upper gap may also be described as being formed between the upper edge of the baffle 112 and the lower edge of the path of travel of the upper, conveying run 7A of conveyor 7 and the lower gap as being formed between the lower edge of the baffle 113 and the upper edge of the path of travel of the lower, return run 7B of conveyor 7. It is also foreseen that the duct 110 by itself could be sized and shaped to span a substantial portion of the gap between the upper and lower runs 7A and 7B of conveyor 7 to serve as the duct and baffle. It is also foreseen that the structure used to form the baffles 112 and 113 could be formed in various shapes and configurations. As shown in FIG. 7, brackets 114 may be used to connect the diffuser duct 102 to the transition section housing 12.

An air discharge opening or slot 115 is formed along a front surface of the duct 110 on the side facing the drying section 2. Reinforcing straps 118 may be mounted to the duct 110 on opposite sides of and bridging the gap across the air discharge slot 115 to reinforce the duct 110 along the slot 115. Blowing ambient air into the transition section 4 through duct 110 creates an area of relatively neutral pressure in the transition section 4 in relation to the pressure in the drying section 2 interrupting or resisting the flow of heated air from the drying section 2 through the transition section 4 and into the cooling section 3, and thereby reducing the amount of heat transferred from the drying section 2 to the cooling section 4 and increasing the efficiency of the system. As shown in FIG. 8 by the three arrows A extending through the air discharge opening 115 in duct 110, air is directed or diffuses out of the duct 110 toward the heating section 2 and in a direction opposite to the direction or path of travel of the upper, conveying run 7A of conveyor 7.

The pressurization fan or blower 103 is preferably mounted on a stand 125, in which the legs or feet may be height adjustable so that the height of the pressurization assembly may be adjusted vertically to fit the diffuser 102 into an opening typically created in the wall of the transition section 4. Other blower mounting positions are possible, if required by physical barriers encountered adjacent to the cooling section 3.

Figure 9:
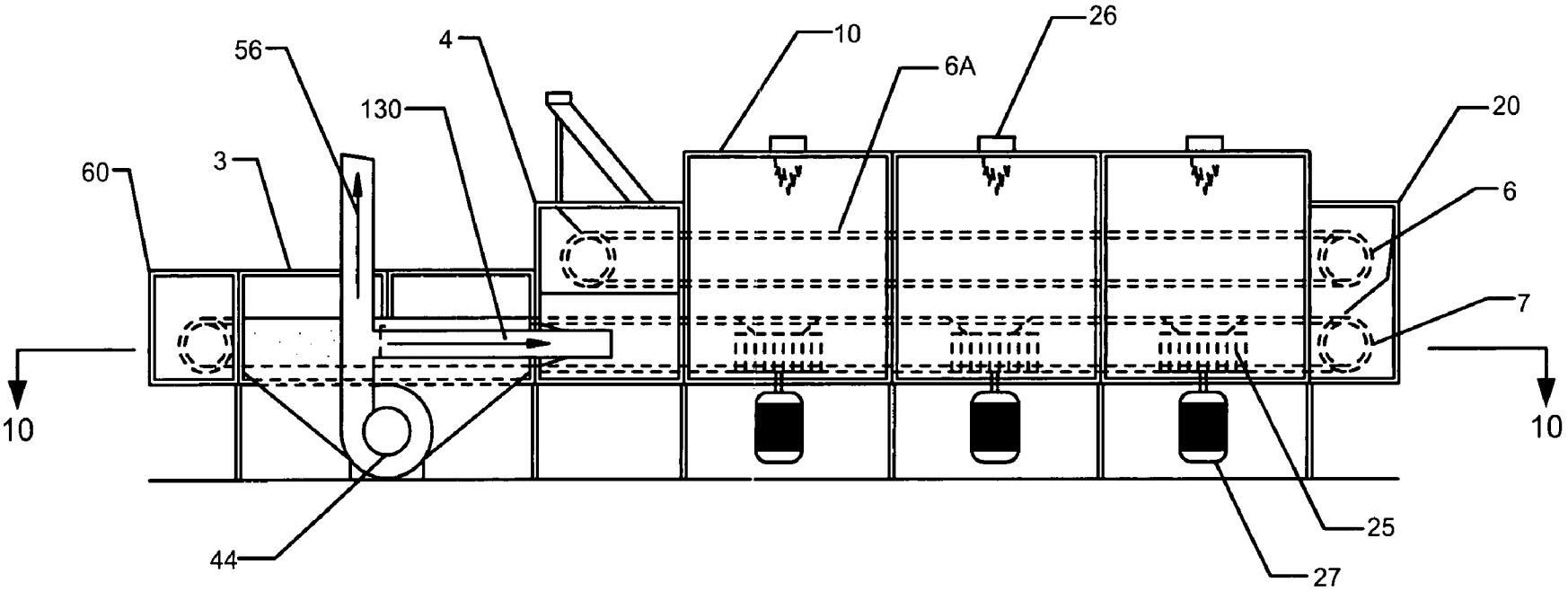
FIG. 9 is a longitudinal diagrammatic view of an alternative embodiment of a pressurization assembly for a conveyor dryer of the type shown in FIG. 1 whereby a portion of the cooling fan exhaust air stream is used to supply relatively pressurized air to the transition section.
Figure 10:
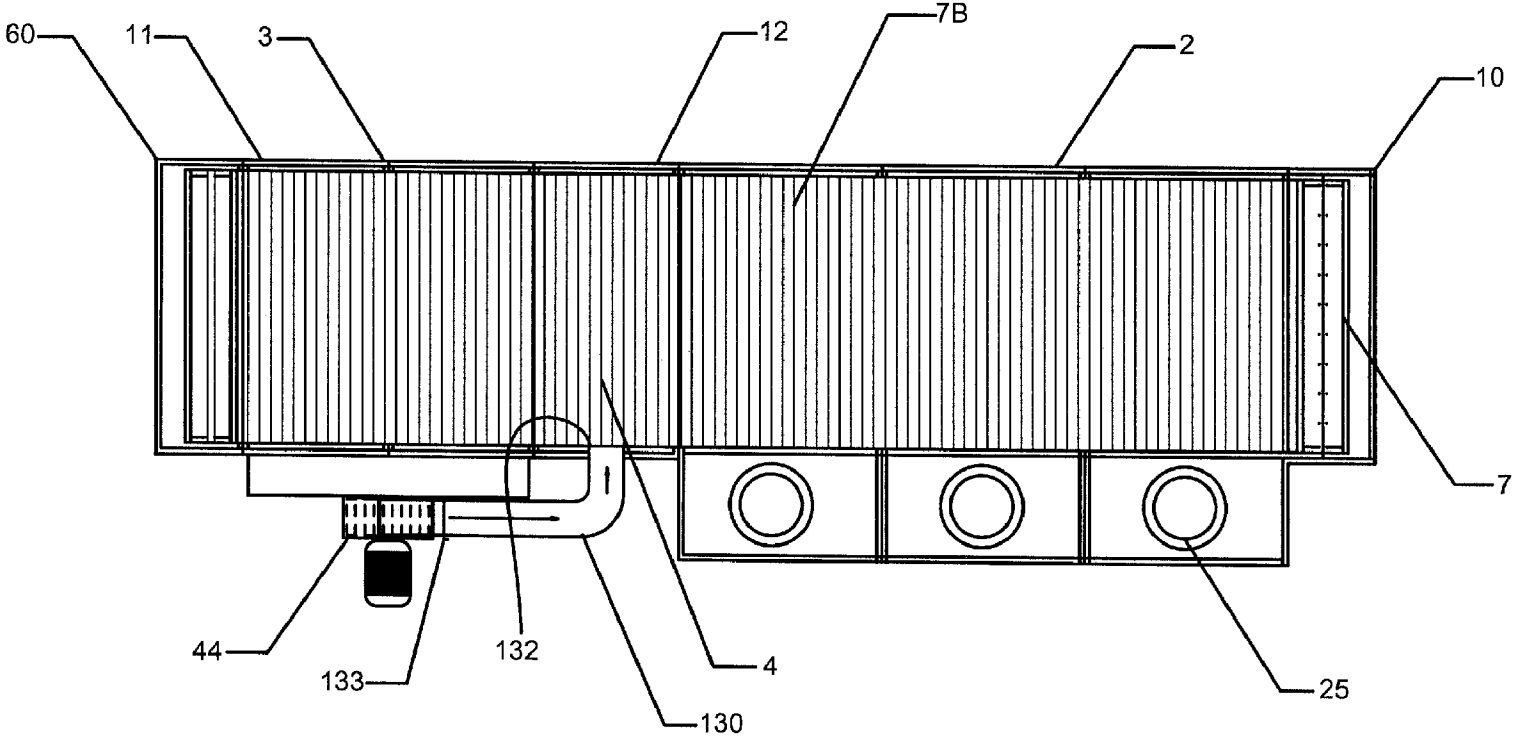
FIG. 10 is a reduced scale cross-sectional view taken generally along line 10-10 of FIG. 9.

Referring to FIGS. 9 and 10, an alternative embodiment is shown for distributing a stream of air into, or pressurizing, the transition section 4 to interrupt or resist migration of pressurized hot air from the drying section 2 through the transition section 4 into the cooling section 3. In the embodiment shown in FIGS. 9 and 10, a portion of the air blown out exhaust duct 56 by the cooling fan 44 is redirected into the transition section 4 by a transition duct 130. The transition duct 130 may be connected to the transition section 4 through an opening 132 cut in a side of the transition section housing 12. The opening 132 is preferably positioned to deliver the pressurized air between the upper and lower runs 7A and 7B of the lower conveyor 7. It is also to be understood that the transition duct 130 extending off of exhaust duct 56 may be connected to a diffuser extending into the transition section 4, similar to diffuser 102.

Figure 11:
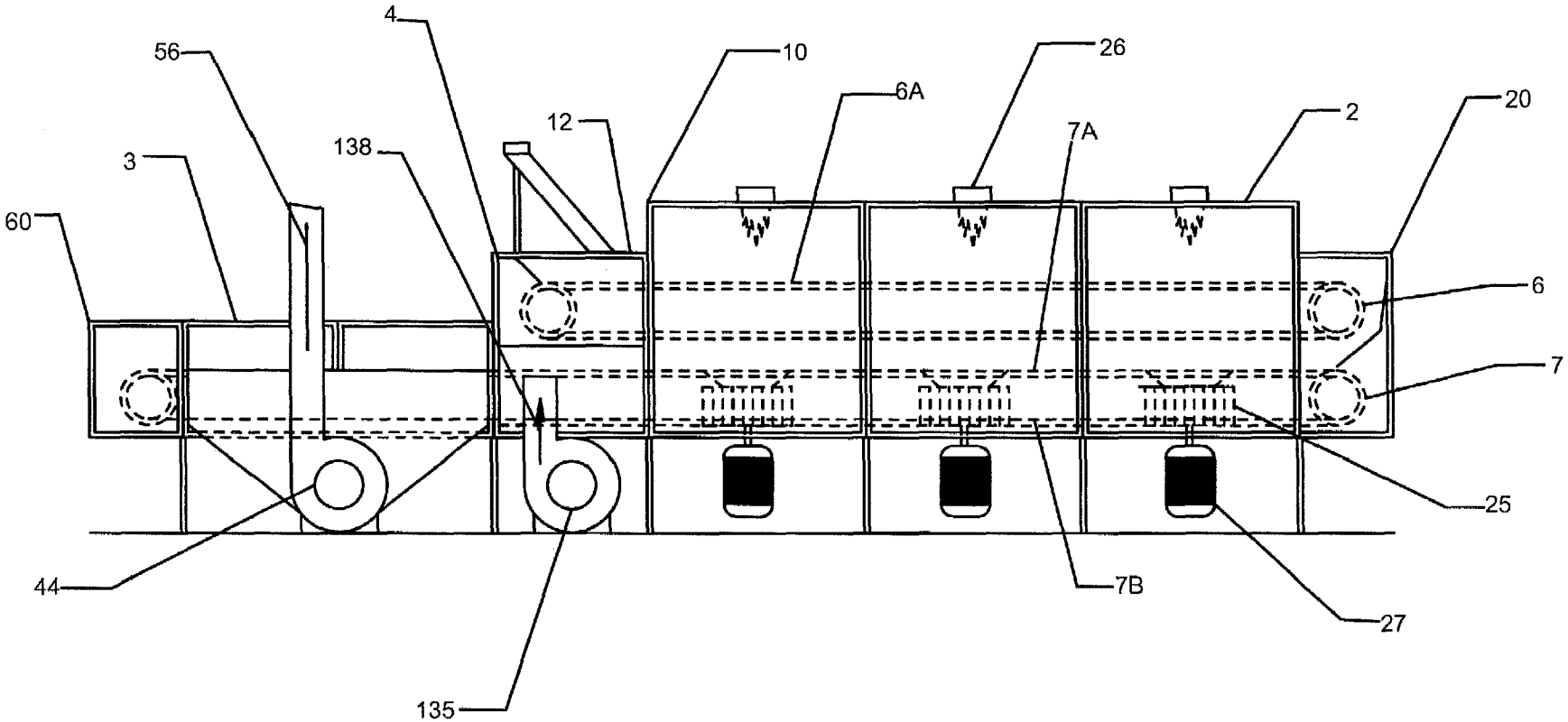
FIG. 11 is a longitudinal diagrammatic view of another alternative embodiment of a pressurization assembly for a conveyor dryer of the type shown in FIG. 1.

A damper 133 may be incorporated into the transition duct 130 of the embodiment shown in FIGS. 9 and 10), transition duct 138 of the embodiment of FIG. 11, or in the diffuser duct 110 of the previously discussed embodiment, to permit control of the air flow therethrough. Control of the transition section air pressure may be manual or may include an automated system wherein sensors and actuators are used to adjust damper position or fan speed to maintain a pressure set point or to provide electronically pre-programmed pressure set-points.

Referring to FIG. 11, a further alternative embodiment is shown, wherein a separate pressurization blower 135 and blower motor (not shown) are provided for supplying pressurized air through a separate transition section duct 138 into the transition section 4, through an opening in a sidewall of the transition section housing 12. The pressurized air from transition duct 130 or duct 138 functions to increase the air pressure in the transition section 4 to resist or interrupt the flow of pressurized hot air from the drying section 2 into the cooling section 3. The pressurized air delivered through ducts 130 or 138 create a pressurization zone in the lower portion of the transition section 4 to neutralize the pressure differential between the drying section 2 and the transition section 4.

Figure 12:
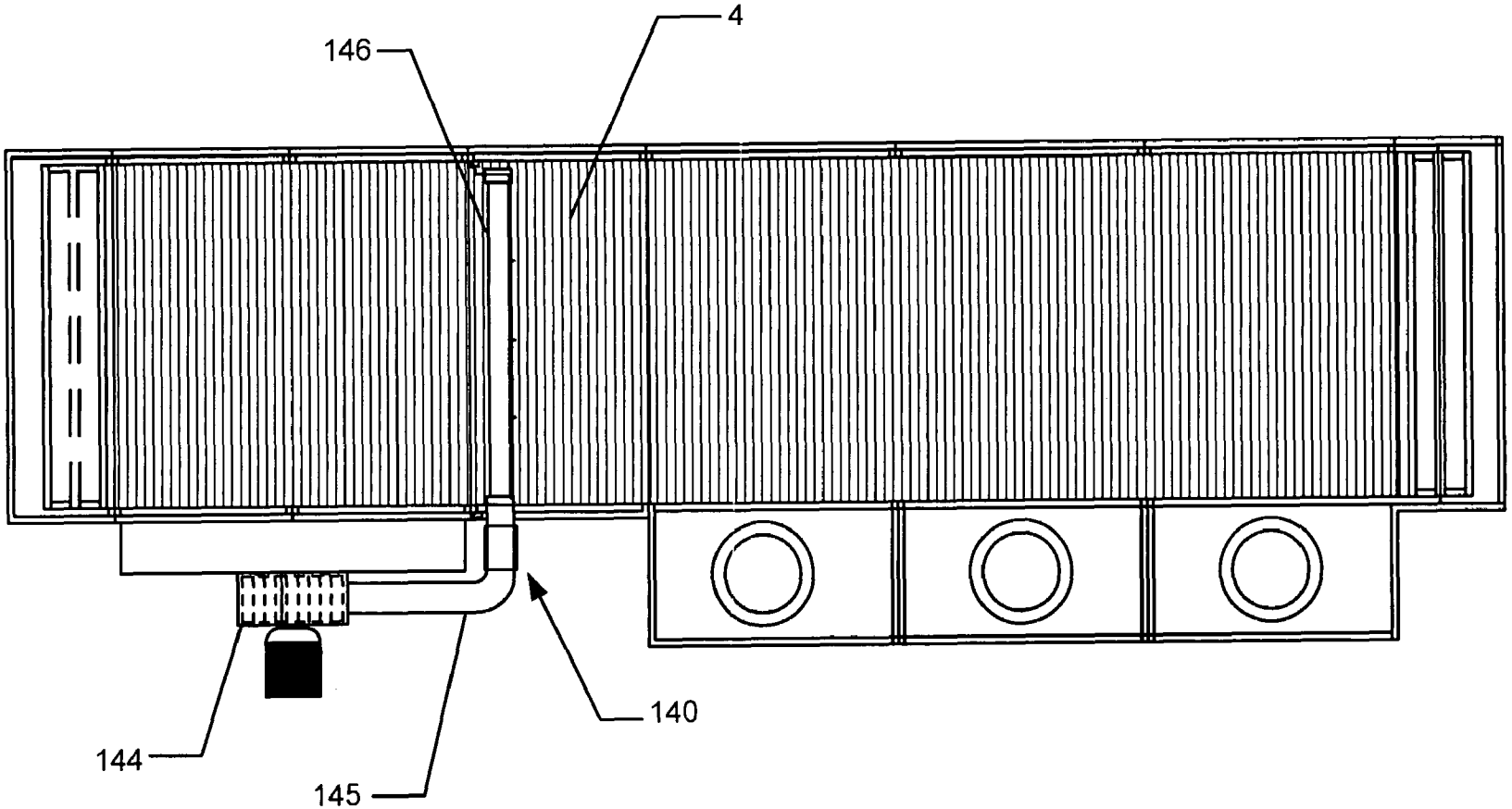
FIG. 12 is a cross-sectional view similar to FIG. 6 showing an alternative embodiment of a pressurization assembly for a conveyor dryer of the type shown in FIG. 1, whereby a portion of the cooling fan exhaust air stream is used to supply relatively pressurized air to the transition section through a diffuser.

FIG. 12 is a cross-sectional view similar to FIG. 6 showing an alternative embodiment of a pressurization assembly 140 for a conveyor dryer of the type shown in FIG. 1, whereby a portion of the exhaust air from a cooling fan 144 is directed into the transition section 4, through a transition duct 145 and a diffuser 146, similar to the diffuser 102 discussed previously.

In the embodiments discussed above, the air blown into the transition section 4 is either ambient air or the exhaust from the cooling fan 44, which is generally warmer than ambient air due to the heat picked up by the air stream in cooling the product on the conveyor 7. Both the ambient air and the exhaust from the cooling fan 44 are cooler than the heated air from the drying section 2.

In a further embodiment, not shown, heated air leaving the drying section 2 through the dryer outlet 35, as shown in FIG. 8, is allowed to escape the drying section 2 prior to entering the cooling section 3 through provision of an open vent in the side wall of the transition section 4. In another embodiment, of the type shown in FIGS. 9-11, a physical barrier or cooling section baffle (not shown), could be installed to extend across the space between the upper, conveying run 7A and the lower return run 7B of lower conveyor 7 generally across the cooler section inlet opening 40. The cooling section baffle (similar to baffle 37) helps to hold the pressurized air delivered through transition duct 130 in the transition section 4.

It is to be understood that while certain forms of the present invention have been illustrated and described herein, it is not to be limited to the specific forms or arrangement of parts described and shown. For example, although in the embodiments shown, a stream of pressurized air is directed into the transition section 4 between the upper and lower runs 7A and 7B of the lower conveyor 7, it is foreseen that the pressurized area could enter into different locations in the transition section 4, or in an area that might otherwise be referred to as the front of the cooling section 3. In addition, although the dryers shown all comprise two pass dryers, it is to be understood that the improvements of the present invention could also be used with a single pass conveyor system or multiple pass systems. In particular, the improvements could be utilized with a single conveyor that extends from the drying section to the cooling section. It is also to be understood that the improvements could be utilized with a system in which the lower, return run of the lower conveyor (or only conveyor) extends out of and runs generally beneath the floor of the dryer housing. In such an application, pressurized air is preferably introduced into the transition section between the upper, conveying run and the floor of the transition section. It is also to be understood that the improvements could be used with ovens which utilize other heat sources, including steam heat, electric heaters and hot water or oil heaters.

What is claimed is:

1. In a conveyor oven for heating a product, said conveyor oven having a conveyor with a conveying run extending from a heating section, through a transition section and into a cooling section, and a return run extending from said cooling section to said heating section, said heating section having a heating section housing having at least one heating element mounted therein and at least one heating section blower for circulating air through said heating section and past said heating element to heat the circulated air and creating an area of relatively positive pressure beneath said conveying run of said conveyor in said heating section, said cooling section having a cooling fan connected to a cooling section housing through an inlet in said cooling section housing for drawing-cooling air through said cooling section and creating an area of relatively low pressure beneath said conveying run of said conveyor in said cooling section, and said heating section is divided from said transition section by one or more baffles interposed between said transition section and said heating section and between said conveying run and said return run and wherein no heating elements and no means for circulating air through said transition section are incorporated into said transition section, the improvement comprising means connected to and extending through a housing for said transition section for introducing ambient air into said transition section between said conveying run and said return run to thereby increase the air pressure in said transition section relative to the air pressures in areas of said cooling section and of said heating section below said conveying run and proximate said transition section wherein the temperature of the air introduced into said transition section is lower than the temperature of the heated air in said drying section.

2. The apparatus of claim 1 wherein said means for introducing air comprises an auxiliary blower in communication with a conduit, said conduit in communication with said transition section and opening into said transition section below said conveying run and above said return run.

3. The apparatus as in claim 1 wherein said means for introducing air comprises a nozzle extending into said transition section beneath and transverse to said conveying run and across a substantial portion of the width of said conveyor; said nozzle having at least one air discharge opening formed therein and connected to an auxiliary blower mounted external to said transition section and connected to said nozzle by a conduit for supplying air through said nozzle and into said transition section.

4. The apparatus as in claim 3 wherein said nozzle spans a substantial portion of the distance between a lower edge of a path of travel of said conveying run and an upper edge of a path of travel of said return run of said conveyor said air discharge opening of said nozzle opening toward said heating section such that air discharged therethrough diffuses in a direction opposite the direction of travel of said conveying run.

5. In a conveyor oven for heating a product, said conveyor oven having a conveyor with a conveying run extending from a heating section, through a transition section and into a cooling section, and a return run extending from said cooling section to said heating section, said heating section having at least one heating section blower for circulating heated air through said heating section and creating an area of relatively positive pressure beneath said conveying run of said conveyor in said heating section, said cooling section having a cooling fan for circulating cooling air through said cooling section and creating an area of relatively low pressure beneath said conveying run of said conveyor in said cooling section, the improvement comprising a diffuser extending into said transition section beneath said conveying run for introducing air into said transition section below said conveying run and above said return run; said diffuser connected to an auxiliary blower for supplying air through said diffuser and into said transition section; and wherein said diffuser comprises a duct having an air discharge opening formed therein facing said heating section and with an upper baffle extending above said duct and a lower baffle extending below said duct.

6. A method for minimizing the migration of heated air from a relatively positive pressure heating section of a conveyor oven to a relatively negative pressure cooling section which is separated from the heating section by a transition section, and in which product to be heated is conveyed on a continuous conveyor having a conveying run extending from said heating section through said transition section and into said cooling section, said heating section having a heating section housing having at least one heating element positioned therein with at least one heating section blower circulating air heated by said at least one heating element through said heating section; said cooling section having a cooling section housing and a cooling section blower connected to said cooling section housing for drawing air through said cooling section housing and venting said air out of said cooling section and the transition section having a transition section housing separating the transition section from said heating section and said cooling section wherein said transition section does not include a heating element located therein or a blower connected to said transition section housing for circulating heated air through said transition section, the method comprising the step of directing a stream of ambient air or a stream of air from an exhaust for said cooling section into said transition section and between said conveying run and a return run of said conveyor, and wherein said stream of air directed into said transition section is cooler than the heated air in said heating section.

7. The method as in claim 6 wherein said conveyor is porous and the step of directing the stream of air into the transition section further comprises directing the stream of air through a nozzle inserted between said conveying run and said return run of said conveyor and in a direction opposite said direction of travel of said conveying run.

8. The method as in claim 7 further comprising the step of sizing said nozzle to extend across a substantial portion of said transition section.

9. The method as in claim 7 wherein said step of directing said stream of air into said transition section comprises directing said stream of air toward said heating section and in a direction opposite the direction of travel of the conveying run.

10. A method for minimizing the migration of heated air within a conveyor oven having a continuous conveyer extending from a heating section, through a transition section and to a cooling section, the conveyor including a conveying run and an underlying return run, said heating section having at least one heating element and at least one heating section blower for circulating heated air through said heating section and past said heating element and wherein no heating elements are located in said transition section, the method comprising the step of inserting a diffuser, comprising a duct with at least one air discharge opening formed therein, into the transition section between the conveying run and the underlying return run and transverse to the path of travel of the conveying run and directing a stream of air through the diffuser and into the transition section to increase the pressure of said air in said transition section relative to said cooling section and wherein the stream of air is cooler than said air in the heating section.

11. The method as in claim 10 further comprising the step of positioning a baffle to project upward from said diffuser toward the conveying run.

12. The method as in claim 10 further comprising the step of positioning a baffle to project downward from said diffuser toward the return run.

13. The method as in claim 10 wherein the step of directing the stream of air includes directing the stream of air toward the heating section and in a direction opposite the direction of travel of the conveying run.

14. In a conveyor oven for heating a product, said conveyor oven having a conveying run extending from a heating section, through a transition section and thence into a cooling section, said heating section having at least one blower blowing heated air past said product on said conveying run, said cooling section having at least one fan drawing relatively cool air past said product on said conveying run, the improvement comprising a diffuser comprising a duct having at least one air discharge opening and extending into said conveyor oven and across a portion of said conveyor transverse to a direction of travel of said conveyor run, said diffuser flow connected to a source of pressurized air for directing a stream of air into said transition section to increase the air pressure in said transition section relative to the air pressures in said heating section and said cooling section, thereby reducing migration of heated air from said heated section to said cooling section.

15. The conveyor oven as in claim 14 wherein said air discharge opening in said duct opens toward said heating section.

16. The conveyor over as in claim 15 wherein said duct extends substantially across said transition section adjacent an entrance opening to said cooling section.

17. In a conveyor oven for heating a product, said conveyor oven having a conveyor with a conveying run extending from a heating section, through a transition section and into a cooling section, and a return run extending from said cooling section to said heating section, said heating section having a heating section housing having at least one heating element mounted therein and at least one heating section blower for circulating air through said heating section and past said heating element to heat the circulated air and creating an area of relatively positive pressure beneath said conveying run of said conveyor in said heating section, said cooling section having a cooling fan connected to a cooling section housing through an inlet in said cooling section housing for drawing cooling air through said cooling section and creating an area of relatively low pressure beneath said conveying run of said conveyor in said cooling section and exhausting said air drawn through said cooling section through a cooling section exhaust duct, and said heating section is divided from said transition section by one or more baffles interposed between said transition section and said heating section and between said conveying run and said return run and wherein no heating elements and no means for circulating air through said transition section are incorporated into said transition section, the improvement comprising means connected to and extending through a housing for said transition section for introducing exhaust air from said cooling section exhaust duct into said transition section between said conveying run and said return run to thereby increase the air pressure in said transition section relative to the air pressures in areas of said cooling section and of said heating section below said conveying run and proximate said transition section wherein the temperature of the air introduced into said transition section is lower than the temperature of the heated air in said drying section.

18. The apparatus of claim 17 wherein said means for introducing air comprises a nozzle connected to said cooling section exhaust duct and extending into said transition section beneath and transverse to said conveying run and across a substantial portion of the width of said conveyor; said nozzle spans a substantial portion of the distance between a lower edge of a path of travel of said conveying run and an upper edge of a path of travel of said return run of said conveyor; said nozzle having at least one air discharge opening toward said heating section such that air discharged therethrough diffuses in a direction opposite the direction of travel of said conveying run.

* * * * *